United States Patent [19]

Steiner

[11] Patent Number: 4,735,326

[45] Date of Patent: Apr. 5, 1988

[54] CLOTHES DRYING APPARATUS

[76] Inventor: Walter Steiner, Saentisstrasse 52, CH-8311 Bruetten, Switzerland

[21] Appl. No.: 940,629

[22] Filed: Dec. 11, 1986

[30] Foreign Application Priority Data

Jan. 8, 1986 [EP] European Pat. Off. ..... 86100148.5
Jan. 8, 1986 [EP] European Pat. Off. ..... 86100149.3

[51] Int. Cl.[4] ..... A47B 47/00

[52] U.S. Cl. ..... 211/197; 211/119.01; 211/119.15

[58] Field of Search ..... 211/197, 196, 119.01, 211/119.15, 1.3; 135/105; 160/53

[56] References Cited

U.S. PATENT DOCUMENTS 2,567,270 9/1951 Belich ..... 211/119.15 X

FOREIGN PATENT DOCUMENTS 3200013 8/1983 Fed. Rep. of Germany .
390863 8/1965 Switzerland .

*Primary Examiner*—Ramon S. Britts
*Assistant Examiner*—Blair M. Johnson
*Attorney, Agent, or Firm*—Tarolli, Sundheim & Covell

[57] ABSTRACT

The invention provides a clothes drying apparatus with a central post member, a collar member axially displaceably mounted on the supporting post member and a plurality of support arms. A plurality of clothes line portions extend between the support arms. Operating means are provided to spread the support arms from a rest position into an extended position in which the clothes line portions extending between the support arms are in an essentially stretched condition. In order to avoid a contamination and muddling of the hanging down line portions when the apparatus is in its inoperative position, cavities are provided between the central post and the support arms which receive and protect the hanging down line portions. To direct the cloth line portions, which loosely hang down on collapsing the clothes drying apparatus, into the cavities, guiding means are provided which are operatively connected to the clothes line portions, e.g. weight bodies fixed to the cloth line, or which engage some of the clothes line portion, e.g. gliding members slidably mounted along the support arms, which have projecting tappets forcing the hanging down clothes line portions towards the central supporting post.

17 Claims, 6 Drawing Sheets

CLOTHES DRYING APPARATUS

BACKGROUND OF THE INVENTION

The present invention relates to a clothes drying apparatus which comprises a central, elongate supporting post member, a collar member surrounding the supporting post member which includes a plurality of radially protruding webs, this collar member being axially displaceably mounted on the supporting post member. The apparatus further comprises a plurality of support arms, one end thereof being pivotally mounted via a first joint on the radially protruding webs, and a clothes line constituting a plurality of clothes line portions which extend between the support arms.

The central supporting post member is equipped with a head member mounted on the top of the supporting post member, and a plurality of strut members, one end thereof being pivotally connected to the head member and the other end thereof being pivotally connected via a second joint to one of the support arms.

Operating means are provided to spread the support arms from a rest position in which the support arms are in an essentially parallel position to the central supporting post member, into an extended or spread out position in which the clothes line portions extending between the support arms are in an essentially stretched condition, by displacing the collar member from a lower rest position towards said head member into an operative position.

PRIOR ART

A clothes drying apparatus of this or a similar kind is known e.g. from Swiss Pat. No. 390,863, and further known from various different embodiments commercially available and in widespread use in households.

In such a known apparatus, there are several disadvantages: The support arms being in their inoperative rest position parallel to the central supporting post, the clothes line portions extending between the support arms loosely hang downwards. Consequently they are subject to contamination if the clothes drying apparatus is not enclosed by a (e.g. textile or plastic) cover, and they are easily muddled which makes a following spreading out most inconvenient. Furthermore, if such a clothes drying apparatus is left standing at the place of use in its inoperative position, its appearance is non-esthetic as a result of the hanging down clothes line portions.

In order to avoid such disadvantages, it is proposed e.g. in German Patent Publication No. 32 00 013 to improve a clothes drying apparatus of the kind referred to by providing it with a clothes line pulling-back or retraction device which automatically pulls the clothes lines back into the support arm portions at the time of folding up the clothes drying apparatus into its inoperative position. In theory, of course, it should be possible to achieve the desired effect by providing such a retraction device, but, in fact, it comprises a great number of trouble-prone, wear-exposed parts. However, this is particularly not desired in a household acticle for daily use because such an article should perform in a problem free manner for many years. There is also a cost factor because a relatively complicated retraction mechanism increases manufacturing costs of such a clothes drying apparatus to a considerable extent, particularly if a robust construction which is not sensitive to incorrect operation is required.

The inventor of this application has disclosed an improved clothes drying apparatus of the kind referred to hereinabove in his co-pending patent application Ser. No. 918,373, filed on Oct. 14, 1986, and entitled "A Clothes Drying Apparatus". In this apparatus, when the support arms are folded in, i.e. are in an essentially parallel position with regard to the central supporting post member, at least partially closed cavities are formed between the support arms and the central supporting post member. These cavities are adapted to receive end enclose the downwardly hanging clothes line portions. Thus, it is ensured that the hanging down clothes line portions are protected against contamination and muddling if the apparatus is in its inoperative position without the need to provide a complicated and expensive retraction mechanism. Simultaneously, an estethically attractive appearance of the collapsed, inoperative clothes drying apparatus is provided.

OBJECTS OF THE INVENTION

It is a primary object of the present invention to further improve a clothes drying apparatus of the kind referred to hereinabove, particularly to provide means which assist in directing the hanging down clothes line portions into the cavities on collapsing the clothes drying apparatus.

It is a further object of the invention to improve a clothes drying apparatus of the kind referred to hereinabove such that the hanging down clothes line portions are directed into the cavities automatically on collapsing the clothes drying apparatus, without the need of any additional manipulation and without further manual assistance.

It is a still further object of the invention to improve a clothes drying apparatus of the kind referred to hereinabove such that the hanging down clothes line portions are reliably and neatly directed into the cavities on collapsing the clothes drying apparatus even if the clothes line is comparatively stiff, e.g. due to low temperature.

SUMMARY OF THE INVENTION

The invention provides a clothes drying apparatus which comprises a central, elongate supporting post member with a collar member surrounding the supporting post member which collar includes a plurality of radially protruding webs. The collar member is axially displaceably mounted on the supporting post member.

The apparatus further comprises a plurality of support arms, one end thereof being pivotally mounted via a first joint on the radially protruding webs, and a clothes line comprising a plurality of clothes line portions extending between said support arms.

The supporting post member includes a head member mounted on the top of the supporting post member, and a plurality of strut members is provided, one end thereof being pivotally connected to the head member and the other end thereof being pivotally connected via a second joint to each one of the support arms.

In order to spread out the support arms from a rest position in which the arms are in an essentially parallel position with regard to the central supporting post member into an extended position in which the clothes line portions extending between the support arms are in an essentially stretched condition, operating means are provided which displace the collar member from a lower rest position towards the head member.

When the support arms are in said essentially parallel position with regard to said central supporting post, at least partially closed cavities are formed between the support arms and the central supporting post, said cavities being adapted to receive and enclose the downwardly hanging clothes line portions of said clothes line.

In order to direct the clothes line portions, which loosely hang down on collapsing the clothes drying apparatus, into the cavities, guiding means are provided which are operatively connected to or engage at least some of the clothes line portions.

In a first embodiment of the apparatus according to the invention, the guiding means are in the form of weight body members attached to the clothes line portions, either slidingly or fixedly, as appropriate. Usually it is not required to provide all clothes line portions with the weight body members, but it will be sufficient to provide only one or some of the outermost clothes line portions with the weight body members, since on collapsing the clothes drying apparatus, the hanging down outermost clothes line portions overlap the more inwardly located clothes line portions and exert an inwardly directed force to them such that they are guided into the cavities as well.

The weight body members may be manufactured of stainless metallic material, e.g. in the shape of wire sections helically wound around the clothes line portions, or in the shape of hollow tubular bodies drawn onto the clothes line portions. Different line portions may have weight body members of different size or weight; advantageously, the more outwardly located a clothes line portion is, the heavier the associated wight body member.

In a second embodiment of the apparatus according to the invention, the guiding means are in the form of gliding body members which are mounted on at least some of the support arms and which are displaceable along said support arms. The gliding body members comprise at least one, but preferably a plurality of tappets or engaging dogs, arranged one next to each other, which engage or are operatively connected to the clothes line portions.

Usually it will be sufficient for the gliding body members to be mounted freely displaceable along the associated support arm such that they slide downwards under the influence of gravity on collapsing the the clothes drying apparatus, particularly if a relatively soft clothes line is used. However, if a relatively stiff clothes line is mounted on the clothes drying apparatus, or if the clothes line becomes stiff due to low temperature or aging, it may be convenient to provide a retraction weight in the interior of the central supporting post member which is connected by means of a rope via deflection pulleys to the lower end of the gliding body member. Under unfavourable conditions, e.g. if a jamming of the gliding body member is likely to occur and/or if a very stiff clothes line is used, it may be necessary to control the movement of the gliding body member bilaterally forcedly e.g. by providing a rope means which is connected to both ends of the gliding body member such that the gliding body member is forcedly displaced downwards on retracting the supporting arms, and such that the gliding body member is forcedly displaced upwards on spreading apart the support arms.

BRIEF DESCRIPTION OF THE DRAWING

In the following, some embodiments of the apparatus according to the invention will be further described, with reference to the enclosed drawings. In the drawings.

DESCRIPTION OF PREFERRED EMBODIMENTS

The general design of such an umbrella-like or spider's webtype clothes drying apparatus is adequately known from constructions thereof available in numerous households, as well as from the aforementioned publications, removing the need to give further detailed explanations or to present additional drawings.

Figure 1:
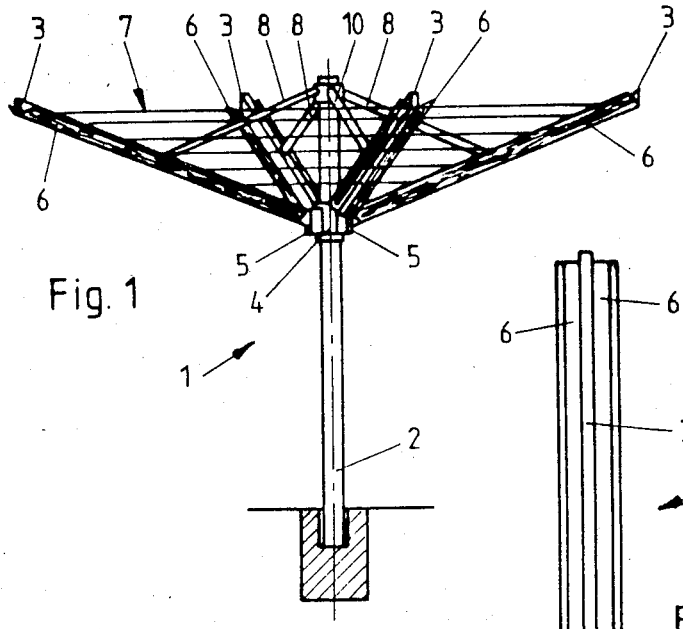
FIG. 1 shows a diagrammatic overall side view of an embodiment of a clothes drying apparatus according to the invention in its operative position, i.e. when extended.
Figure 3:
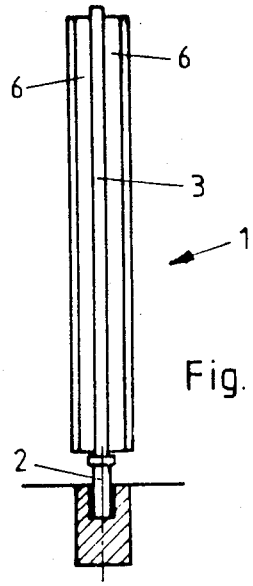
FIG. 3 shows a diagrammatic overall side view of the clothes drying apparatus of FIG. 1 in its inoperative, i.e. collapsed or folded position.

The clothes drying apparatus as shown in the attached drawing comprises a plurality, e.g. four support arms 3 which are arranged in equidistant relationship around a central, vertical supporting post 2. The support arms 3 together serve as a support for a clothes line 7 whose portions 7' extend between the individual support arms 3 when said arms 3 are in their spread out position (i.e. in the operative position of the clothes drying apparatus), as shown in FIGS. 1 and 3.

The central post 2 comprises a slidably mounted collar 4 surrounding the post 2 and having four radially protruding webs 5. The lower ends of the four support arms 3 are pivotally mounted on the webs 5. Struts 8 are provided, one strut 8 being associated to each one supporting arm 3, one end thereof being pivotally mounted on the support arm 3 in a predetermined distance from the linkage 6 and the other end thereof, i.e. the end remote from the support arm 3, is pivotally mounted on a head member 10 arranged on the top of the central post 2.

When the clothes drying apparatus 1 is not in use, the support arms 3 are pivoted against the central post 2 and consequently also the struts 8. The collar 4 is in its lowermost position and the previously tensioned clothes line portions 7' hang loosely down between the support arms 3.

In order to avoid a contamination and a tangling or muddling of the loosely hanging down clothes line portions 7' if the clothes drying apparatus is in its collapsed inoperative position, the present invention generally discloses the provision of cavities adapted to receive the loosely hanging down portions 7' of the clothes line. Those cavities are formed, the support arms 3 being in their folded-in rest position, between the central supporting post 2 and the support arms 3. These cavities can be formed by providing the support arms 3 on either side of their leading edge with projecting blade or vane members, generally designated 6 in FIGS. 1 to 3. As will be further explained hereinafter, these blade or vane members 6, together with the lateral surfaces of the support arms 3 and with certain areas of the outer surface of the central supporting post 2, define four cavities 14 for receiving the downwardly hanging clothes line portions as soon as the clothes drying apparatus 1 is in its collapsed inoperative position.

This situation is shown in a diagrammatic side view in FIG. 3. Even from this diagrammatic view, it will be readily apparent the the clothes drying apparatus according to the invention offers an orderly an esthetic appearance when in collapsed inoperative position. An appropriate and favourable solution would appear to be to provide the support arms 3 with laterally projecting blades or vanes, which are either rigidly or pivotally fixed to the support arms 3, preferably in the region of the leading edges thereof.

Figure 4:
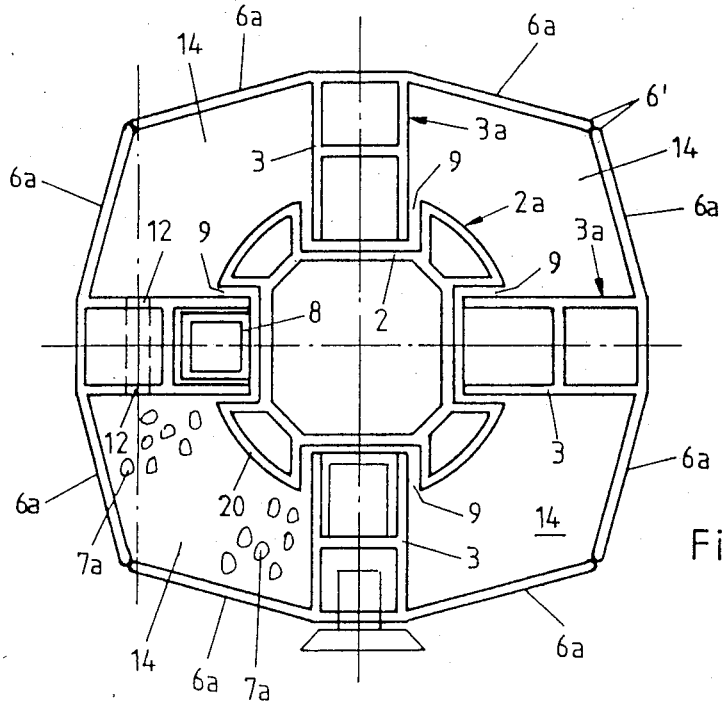
FIG. 4 shows a cross section in a horizontal plane through an embodiment of a clothes drying apparatus according to the invention in its inoperative, i.e. collapsed or folded position.

An example of such a construction is shown in FIG. 4 as a cross sectional view in a horizontal plane through the closed, collapsed clothes drying apparatus. The central supporting post 2 is constituted by a generally cylindrically shaped hollow aluminium profile member which however comprises four axially extending longitudinal recesses 9 uniformly and equidistantially arranged around the outer surface of the profile member. These recesses 9 receive the support arms 3 in the inoperative position of the clothes drying apparatus 1, i.e. when the arms 3 are swung-in towards the post 2. The support arms are constituted by closed box-like profile members; such an arrangement gives a good stability with comparatively small cross-sectional dimensions. The box-like profiles of the support arms 3 have a cavity 11 open towards the central post 2 in which the struts are received upon folding the apparatus together. The portion of the boxlike profile constituting the support are 3 remote from the central post 2 is provided with openings 12 adapted to receive the clothes line 7. The outer closed end portion of the boxlike profile members constituting the support arms 3 is provided, according to the embodiment shown in FIG. 4, with two blade or vane members **6*a* projecting therefrom and mounted in the region of the outer edge of the arm 3. According to the embodiment shown in FIG. 4, those blade members are part of the boxlike profile member constituting the arm 3, i.e. they form part of the profile member. Furthermore, they extend slightly inclined from the lateral face 3*a* of the support arm 3 and enclose therewith a slightly acute angle. The width of the blades or vanes 6*a* is such that the free edge 6' of one of the blades or vanes is located in immediate vicinity of the free edge 6' of the adjacent blade or vane 6*a*** or can even be in contact therewith.

Thus, the clothes drying apparatus being in its collapsed position, four cavities 14 are formed which are defined by the adjacent blade or vane members **6*a*, two adjacent outer surfaces 3*a* of two adjacent support arms 3 and an area 2*a* of the outer surface 2*a* of the central post member 2. These four cavities 14 receive and protect the hanging down clothes line portions 7*a* of the clothes line 7. The length of the blade or vane members 6*a* is such that it is ensured that the complete longitudinal extension of the hanging down line portions is covered or "packed". Thus the blade members 6*a* extend at least from the bore 12 provided for the outermost clothes line portion 7*a*** to the deviation or deflection point of the innermost clothes line portion. Of course, the precise length is to be determined in each individual case.

To ensure that during the folding together of the clothes drying apparatus the loosely hanging down line portions 7' enter the cavities 14, there are provided weight bodies 18 as can be seen in FIG. **2*b***.

In the structure of FIG. **2*b*, each line portion 7' is provided with one centrally positioned weight body 18. The weight body 18 can either be displaceable along the associated line portion 7' or is, preferably, fixed in the center of line portion 7'. However, it is not absolutely necessary to provide all the line portions 7' with weight bodies 18**, as will be explained hereinafter.

Figure 5:
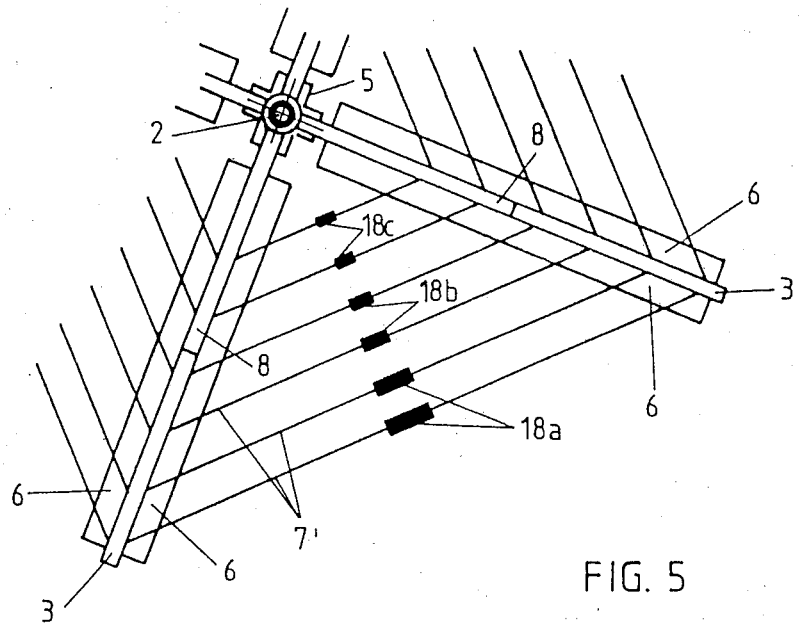
FIG. 5 shows a schematic, enlarged partial top view of a first embodiment of the apparatus according to the invention in its operative position, i.e. when extended.

It can be seen from FIG. 5 that the weight bodies are of different size and weight. The two outermost line portions 7', which have the greatest length, are provided with relatively large and heavy weight bodies **18*a*, the two central line portions 7', which are shorter, are provided with medium-sized, medium-weight weight bodies 18*b*, and the two innermost line portions 7' which are shortest, are provided with relatively small, not very heavy weight bodies 18*c***.

Figure 6:
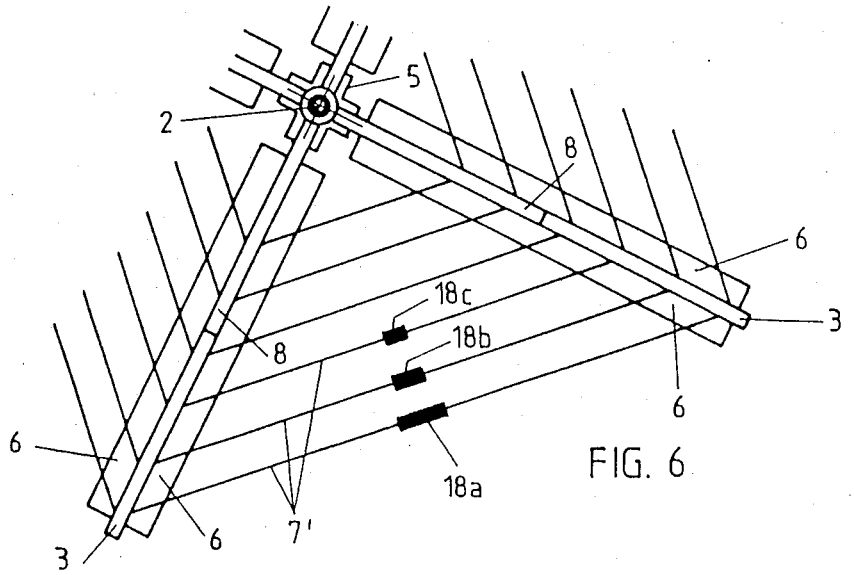
FIG. 6 shows a schematic, enlarged partial top view of a second embodiment of the apparatus according to the invention in its operative position, i.e. when extended.

FIG. 6 shows an example in which only the three outermost line portions 7' are provided with weights. In some cases, particularly if a very flexible clothes line 7 is used, this may prove to be sufficient, because the outer line portion 7' engages over the further inwardly located line portion 7' during the collapsing of the clothes frame and consequently necessarily guide the same toward the central post and into the cavities 14. In FIG. 6, the outermost line portion is provided with a relatively large, heavy weight body **18*a*, the second line portion 7', when viewed from the outside, is provided with a medium-sized weight body 18*b* and the third line portion 7', when viewed from the outside, is provided with a relatively small, light weight body 18*c***.

The reason why the outer line portions are provided with heavier weights than those located further inwards can be easily gathered from FIG. 6, where, in the case of advancing, collapsing or foldng up, the further outwardly located line portions overlap or engage over the inner line portions which might not even be provided with weight bodies and must, therefore, exert a certain load thereon, so that all the loosely downwardly hanging line portions 7' in the end phase of collapsing of the clothes frame, are introduced into the cavities 14. The blade members 6 fitted to the arms 3 assist this introduction. This leads to a reliable "packing" of the hanging line portions 7' into the cavities 14, without additional moving parts being required.

There are various possibilities for the construction and fitting of the weight bodies. As stated, the weight bodies 18 can either slide freely along the associated line portions 7', or are, preferably, arranged in fixed manner in the center thereof.

Figure 7:
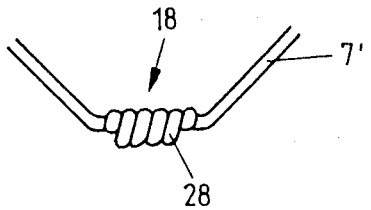
FIGS. 7 to 9 show detailed views of different weight bodies.

FIG. 7 shows a first preferred embodiment of a weight body 18, which is formed by a wire section 28 wound in a few turns round the clothes line portion 7'. The wire 28 is made from stainless metal and, as a function of the closeness of the turns, is displaceable along the clothes line portion 7' or is fixed. The load exerted by said weight body 18 can be adjusted very simiply by varying the length of the wire 28.

Figure 8:
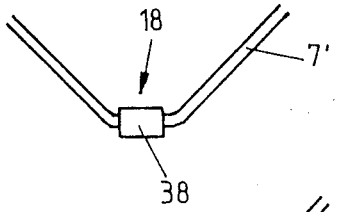
Figure 9:
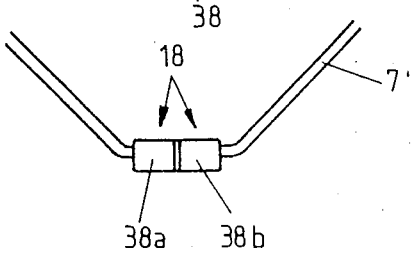

FIG. 8 shows a second preferred embodiment of a weight body 18, which is formed by a cylindrical hollow body 38. The latter is once again made of stainless, metallic material and is mounted on the line portion 7'. The body 38 can be fixed in the center of the line portion 7' by squeezing together the body 38. According to FIG. 9, it is possible to juxtapose two identical weight bodies 38*a*, 38*b* for increasing the mass. However, it is obviously possible to use a single, longer or thicker weight body made from a heavier material with the same dimensions.

In order to ensure during the collapsing of the clothes frame, i.e., on slackening the clothes line 7, that the loosely hanging line portion 7' enter the cavities 14 for receiving the same, according to a second embodiment of the invention, displaceably mounted gliding body members are provided along the arms, which gliding body members ensure that, during retraction of said arms, i.e., during the movement of the arms 3 from the spread-out operating position into the folded-in inoperative position engaging with the central post 2, the loosely downwardly hanging clothes line portions 7' pass into the cavities 14.

Figure 10:
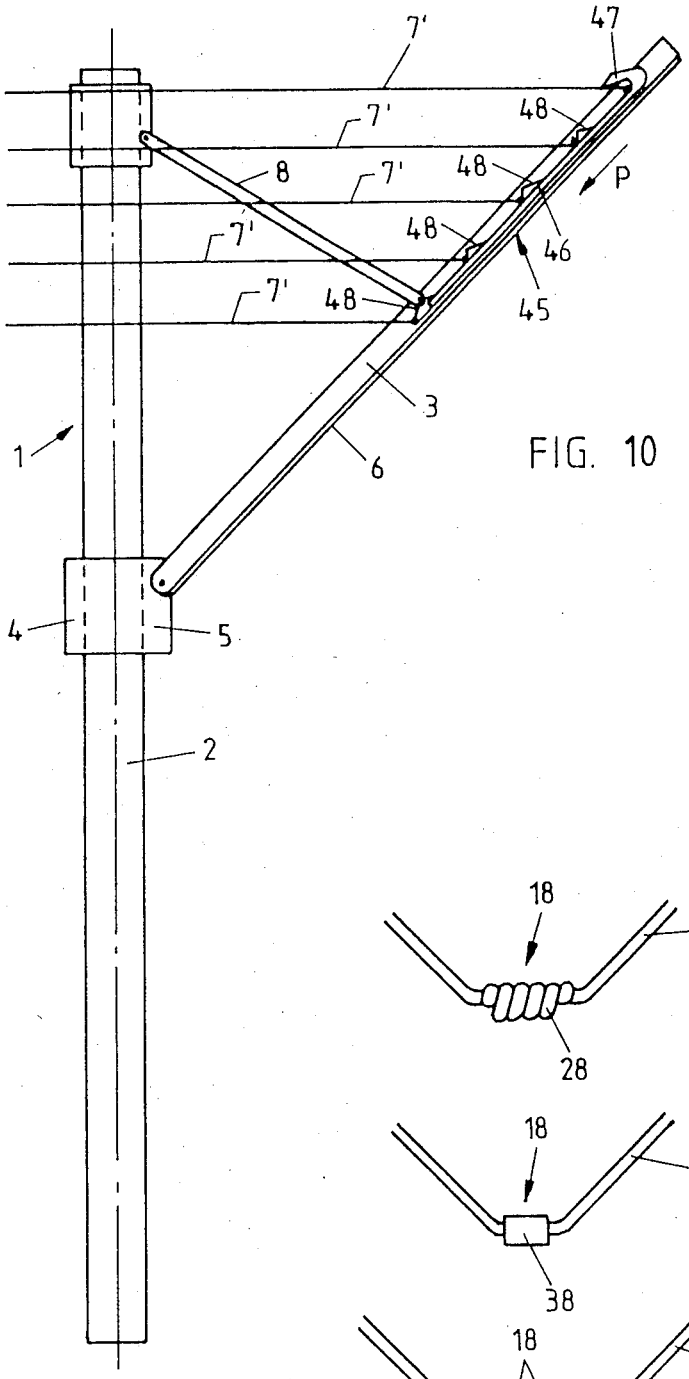
FIG. 10 shows a schematic, enlarged partial side view of a third embodiment of the apparatus according to the invention in its operative position, i.e. when extended.

In the embodiment shown in FIG. 10, the gliding body member 45 is in the form of an elongated gliding body 46 extending in the longitudinal direction of a particular arm 3 and freely displaceable along the same. In the present example, the clothes frame 1 has five line portions 7' extending between the individual arms and the end of each of these is fixed in each case to one arm 3. The length of the gliding body 46 is chosen in such a way that its length roughly corresponds to the distance between the top and bottom line portion 7'.

The gliding body 46 is provided with a first cam 47 permanently overlapping the top line portion 7' and with further cams 48 temporarily overlapping the downwardly following line portions. On folding together the arms 3, when the clothes line portions 7' are slackened and tend to sag downwards, the gliding body 46 slides downwards along a respective arm 3 under the influence of gravity. Cam 47 permanently overlaps the top, longest clothes line portion 7' and, consequently, is drawn downwards as the slackening of the line portions 7' advances. The line portion 7', which become ever shorter from top to bottom and which are connected to the top line portion 7', are temporarily engaged by cam 48, are guided downwards and towards post 2 and are then released again by the instantaneously acting cam so that as the swinging in of the arm 3 advances and as the displacement of the gliding body 46 progresses they are engaged and guided by the following cam 48.

It is thereby ensured that all the loosely hanging down line portions 7' are reliably guided towards post 2 and therefore into the cavities 14, so that they are received therein in a manner protecting them from dirt. With the clothes frame 1 collapsed, in the manner shown in FIG. 3, the gliding body 46 is in its lower end position. On subsequent spreading apart of the arms 3 to the clothes frame 1 again into operation, the gliding body 46 is again raised along the arm 3 by cam 47, which still engages over the top line portion 7', until all line portions 7' are stretched. The cams 48 have no function during this movement of arms 3.

It is obvious that during collapsing of clothes frame 1 the gliding body 46 can also be manually forced down, if this should prove necessary, e.g., with a jamming gliding body or when using lines which (e.g., due to a very low temperature) are very rigid, so that the weight of the gliding body 46 is no longer sufficient for completely satisfactorily introducing the line portions 7' into the cavities 14.

Figure 2A:
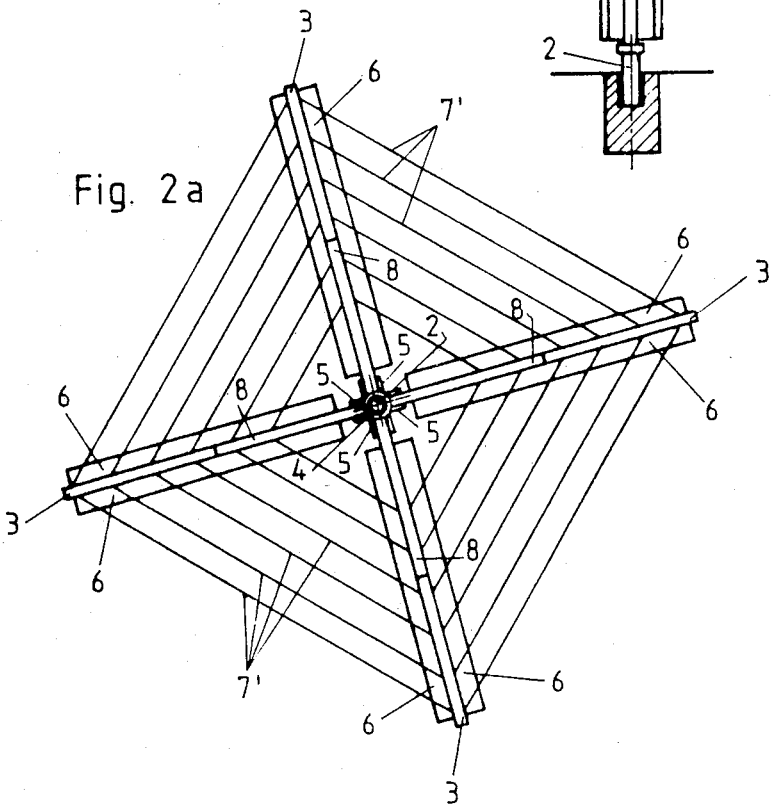
FIGS. 2*a* and 2*b* show an overall view of the apparatus of FIG. 1 from above.
Figure 2B:
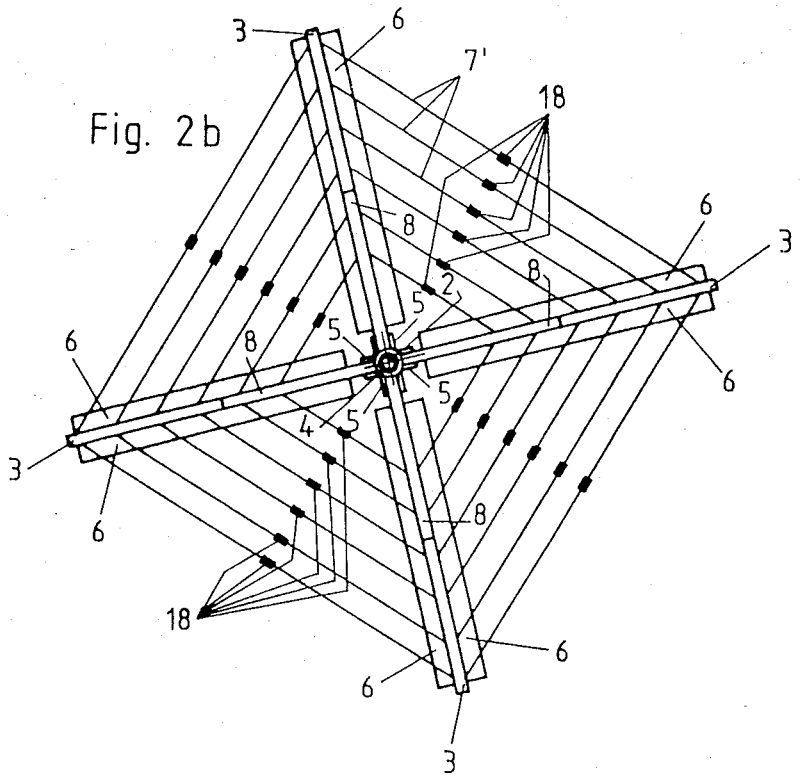

According to a preferred embodiment, in the case of a clothes frame 1 with four arms 3, as shown in FIGS. 1 and 2*a*, there are only two facing arms 3 with gliding bodies 46. Each of the gliding bodies 46 is equipped with two cams 47 and pairwise-arranged cams 48, in such a way that the two cams 47 overlap the top line portions 7' emanating from the associated arm 3 and the pairwise-arranged, further cams 48 cooperate with the underlaying pairs of line portions 7'.

Figure 11:
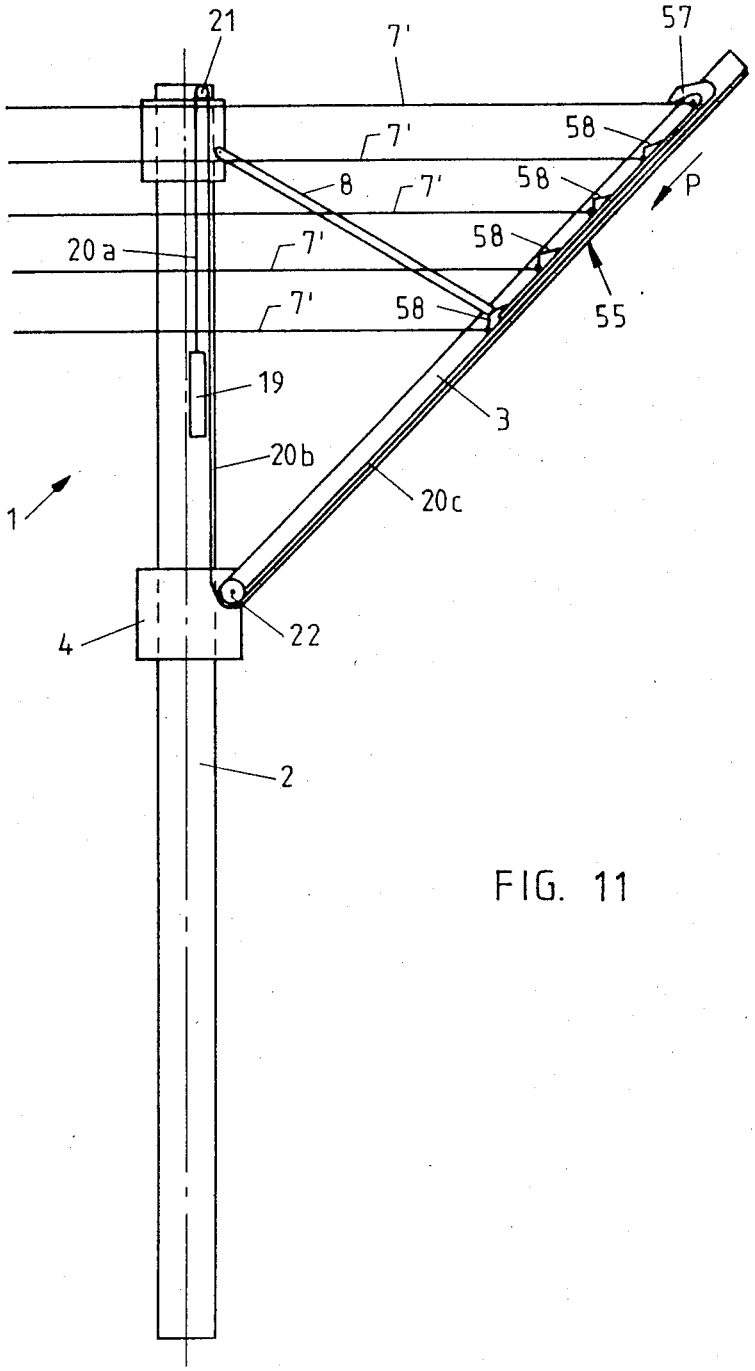
FIG. 11 shows a schematic, enlarged partial side view of a fourth embodiment of the apparatus according to the invention in its operative position, i.e. when extended.

In the embodiment of FIG. 11, a gliding body 55 is forcibly supported for downward movement along an arm 3. To this end, a weight 19 is arranged within the central post 2 connected by a rope to the lower end of the gliding member 55. A first portion 20*a* of the rope extends from the weight 19 to a first guide or return pulley 21 at the top of the post 2, with a second portion 20*b* from the first guide or return pulley 21 to a second guide or return pulley 22, and with a third portion 20*c* from the second guide or return pulley 22 to gliding member 55. This ensures that the gliding body 55 is reliably drawn down along the arm 3, even if the gliding body 55 should jam somewhat and also that even stiff clothes lines are drawn with a smooth pressing action into cavities 14. On extending the clothes frame, as a result of the engagement of the cam 57 on the top line portion of the portions 7', the gliding member 55 is again drawn upwards along arm 3, so that the weight 19 again returns to its upper, initial position.

Figure 12:
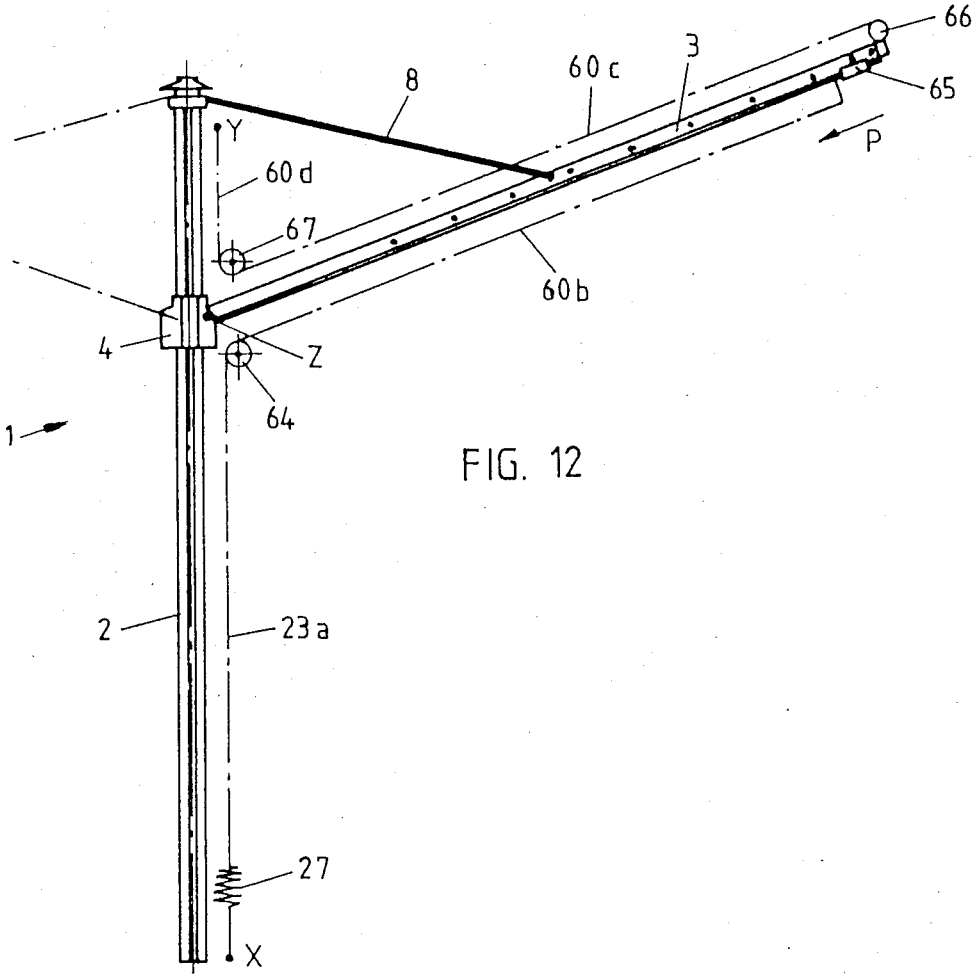
FIG. 12 shows a schematic, enlarged partial side view of a fifth embodiment of the apparatus according to the invention in its operative position, i.e. when extended.
Figure 13:
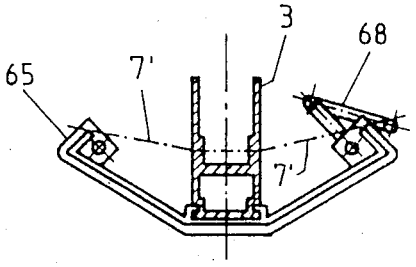
FIG. 13 shows an enlarged detailed cross section from FIG. 12 through a support arm and a gliding member.

FIGS. 12 and 13 show an embodiment of the clothes frame 1, where there is a double-sided acting, forced movement of the gliding member 65. In FIG. 12 the rope comprises a first portion 60*a*, which extends from a lower anchoring point X, e.g., on the post 2, to a first guide or return pulley 64, a second portion 60*b*, which passes from guide pulley 64 to one end of the gliding member 65, a third portion 60*c*, which leads from the other end of the gliding member 65, via a guide pulley 66 arranged at the end of arm 3, to a third guide pulley 67 and finally a fourth portion 60*d* leads from the third guide pulley 67 to an anchoring point Y, e.g., in the vicinity of the upper end of the post 2. It is obvious that the rotation axes of the two guide pulleys 64 and 66 are not positioned outside arm 3 as is shown in the drawing and instead in fact coincide with axis Z, i.e., with the pivot axis of arm 3 on the collar 4. The guide pulley 66 is mounted at the end of the arm 3 in a corresponding manner.

On collapsing or folding up the clothes frame 1, the portions 60*a* and 60*b* are shortened, whilst portions 60*c* and 60*d* are increased in length by the same amount.

Therefore, the gliding member 65 is moved in the direction of arrow P along arm 3. On spreading apart clothes frame 1, the reverse process takes place. Thus, there is a double-sided acting, forced displacement of the gliding member 65. For compensating tolerances and/or any expansion of the rope, it is possible to insert a spring 27 in the vicinity of the anchoring point X.

According to FIG. 13, the gliding member 65 is provided with a laterally projecting cam 68, which projects into the region of the line portions 7' extending away from the arms 3. Thus, during displacement of the gliding member 65 in the direction of arrow P along the arm 3, the line portions 7' are engaged thereon and finally pass in orderly manner into the aforementioned cavities 14.

What I claim is:

1. A clothes drying apparatus comprising:

a central, elongate supporting post member;

a collar member surrounding said central supporting post member and including a plurality of radially protruding webs, the collar member being axially displaceably mounted on said supporting post member;

a plurality of support arms, one end of each support arm being pivotally mounted via a first joint on a respective radially protruding web, a clothes line comprising a plurality of clothes line portions extending between said support arms;

a head member mounted at the top of said central supporting post member;

a plurality of strut members, one end of each strut member being pivotally connected to said head member and the other end of each strut member being pivotally connected via a second joint to a respective one of said support arms;

operating means adapted to spread said support arms from a rest position, in which the arms are in an essentially parallel position with regard to the central supporting post member, into an extended position in which the clothes line portions extending between the support arms are in an essentially stretched condition by displacing said collar member from a lower rest position towards said head member;

said support arms having means which, when said support arms are in said essentially parallel position with regard to said central supporting post, form a plurality of essentially closed cavities between said support arms and said central supporting post, said cavities receiving and enclosing the downwardly hanging clothes line portions of said clothes line; and guiding means associated with said line portions for directing said clothes line portions, which loosely hang down on collapsing the clothes drying apparatus, into said cavities, said guiding means being slidably located on at least one of said support arms and being connected to and movable with said clothes line portions and movable relative to said support arms upon movement of said support arms from the extended position of said support arm into the rest position thereof.

2. A clothes drying apparatus according to claim 1, in which said guiding means are weight body members which are attached to at least some of said clothes line portions.

3. A clothes drying apparatus according to claim 2, in which, in the case of the clothes drying apparatus being spread out, at least the outermost clothes line portions and, in the case of the clothes drying apparatus being collapsed, at least the topmost clothes line portions, respectively, are provided with said weight body members.

4. A clothes drying apparatus according to claim 2, in which, in the case of the clothes drying apparatus being spread out, at least the three outermost clothes line portions and, in the case of the clothes drying apparatus being collapsed, at least the three topmost clothes line portions, respectively, are provided with said weight body members.

5. A clothes drying apparatus according to claim 2, in which said weight body members consist of hollow tubular bodies made of stainless metallic material, drawn onto said clothes line portions.

6. A clothes drying apparatus according to claim 2, in which said weight body members are freely displaceable along the associated clothes line portion.

7. A clothes drying apparatus according to claim 2, in which said weight body members are fixed to the clothes line in the center of the associated clothes line portions.

8. A clothes drying apparatus according to claim 2, in which some of said clothes line portions comprise a plurality of said weight body members.

9. A clothes drying apparatus according to claim 2, in which some of said clothes line portions comprise respective weight body members of different weight.

10. A clothes drying apparatus according to claim 2, in which, in the case of the clothes drying apparatus being spread out, more upwardly located clothes line portions and, in the case of the clothes drying apparatus being collapsed, more outwardly located clothes line portions, respectively, comprise heavier or bigger weight body members than clothes line portions which are located more downwardly and more inwardly, respectively.

11. A clothes drying apparatus comprising:

a central, elongate supporting post member;

a collar member surrounding said central supporting post member and including a plurality of radially protruding webs, the collar member being axially displaceably mounted on said supporting post member;

a plurality of support arms, one end of each support arm being pivotally mounted via a first joint on a respective radially protruding web, a clothes line comprising a plurality of clothes line portions extending between said support arms;

a head member mounted at the top of said central supporting post member;

a plurality of strut members, one end of each strut member being pivotally connected to said head member and the other end of each strut member thereof being pivotally connected via a second joint to a respective one of said support arms;

operating means adapted to spread said support arms from a rest position, in which the arms are in an essentially parallel position with regard to the central supporting post member, into an extended position in which the clothes line portions extending between the support arms are in an essentially stretched condition by displacing said collar member from a lower rest position towards said head member;

at least partially closed cavities formed between said support arms and said central supporting post when said support arms are in said essentially parallel position with regard to said central supporting post, said cavities receiving and enclosing the downwardly hanging clothes line portions of said clothes line; and guiding means for directing said clothes line portions, which loosely hang down on collapsing the clothes drying apparatus, into said cavities;

said guiding means comprising gliding body members which are mounted on at least some of said support arms and which are slidably displaceable along said support arms, said gliding body members comprising at least one cam member engaging at least one of said clothes line portions.

12. A clothes drying apparatus according to claim 11, in which each of said glidng body members comprises a plurality of tappets, cam members arranged next to each other.

13. A clothes drying apparatus according to claim 11, including four support arms located at ninety degree intervals adapted to be spread out, each of two oppositely situated support arms having one of said gliding body members located thereon, each of said gliding body members having at least two cam members projecting in opposite directions and engaging two clothes line portions emanating from the associated support arm.

14. A clothes drying apparatus according to claim 11, in which said gliding body members are mounted freely displaceable along the associated support arm and, on collapsing the clothes drying apparatus, slide downwards under the influence of gravity.

15. A clothed drying apparatus according to claim 11, in which the lower end of said gliding body members are connected to a retraction weight located in the interior of said central post member by means of a rope which is deflected at the lower pivot axis of the associated arm and at the top end of the central post member.

16. A clothes drying apparatus according to claim 11, in which said gliding body members are bilaterally forcedly controlled by means of a rope means, such that on retracting the support arms the gliding body members are moved downwards and on spreading apart the support arms the gliding body members are moved upwards.

17. A clothes drying apparatus comprising:

a central, elongate supporting post member;

a collar member surrounding said central supporting post member and including a plurality of radially protruding webs, the collar member being axially displaceably mounted on said supporting post member;

a plurality of support arms, one end of each support arm being pivotally mounted via a first joint on a respective radiallly protruding web, a clothes line comprising a plurality of clothes line portions extending between said support arms;

a head member mounted at the top of said central supporting post member;

a plurality of strut members, one end of each strut member being pivotally connected to said head member and the other end of each strut member being pivotally connected via a second joint to a respective one of said support arms;

operating means adapted to spread said support arms from a rest position, in which the arms are in an essentially parallel position with regard to the central supporting post member, into an extended position in which the clothes line portions extending between the support arms are in an essentially stretched condition by displacing said collar member from a lower rest position towards said head member;

at least partially closed cavities formed between said support arms and said central supporting post when said support arms are in said essentially parallel position with regard to said central supporting post, said cavities receiving and enclosing the downwardly hanging clothes line portions of said clothes line; and guiding means for directing said clothes line portions, which loosely hang down on collapsing the clothes drying apparatus, into said cavities;

said guiding means being weight body members which are attached to at least some of said clothes line portions, said weight body members consisting of wire sections made of stainless metallic material, helically wound around said clothes line portions.

* * * * *

UNITED STATES PATENT AND TRADEMARK OFFICE

CERTIFICATE OF CORRECTION

PATENT NO. : 4,735,326

DATED : April 5, 1988

INVENTOR(S) : Walter Steiner

It is certified that error appears in the above-identified patent and that said Letters Patent are hereby corrected as shown below:

Column 11, line 18, change "tappets" to -- cam members --.

Signed and Sealed this

Third Day of January, 1989

*Attest:*

DONALD J. QUIGG

*Attesting Officer*

*Commissioner of Patents and Trademarks*